United States Patent [19]

Pozzan

[11] 4,217,832

[45] Aug. 19, 1980

[54] STRUCTURE MADE UP OF SEVERAL COMPONENTS PARTICULARLY FOR USE IN CLASSROOMS

[76] Inventor: Bruno Pozzan, Via Lungo Leogra 33, Schio (Vicenza), Italy

[21] Appl. No.: 889,020

[22] Filed: Mar. 22, 1978

[30] Foreign Application Priority Data

Mar. 22, 1977 [IT] Italy ..... 85551 A/77

[51] Int. Cl.[2] ..... A47B 87/00

[52] U.S. Cl. ..... 108/11; 108/64; 108/91

[58] Field of Search ..... 108/64, 11, 79, 62, 108/91; 248/188.1; D6/55, 176

[56] References Cited

U.S. PATENT DOCUMENTS

| | | | |
|---|---|---|---|
| D. 235,707 | 7/1975 | Platner | D6/55 |
| 1,243,116 | 10/1917 | Spears | 248/188.1 |
| 2,489,933 | 11/1949 | Schwarz | 108/64 |
| 2,944,678 | 7/1960 | Grantham | 108/64 |
| 3,964,401 | 6/1976 | Gutmann, Jr. et al. | 108/64 |

*Primary Examiner*—Francis K. Zugel

*Attorney, Agent, or Firm*—Bucknam and Archer

[57] ABSTRACT

A structure made up of several components, particularly for use in classrooms is described which comprises at least two basic elements, each of said basic elements comprising an L-shaped panel and a T-shaped base parallel to said L-shaped panel and three vertical legs connecting said L-shaped panel to said T-shaped base, two of said legs being mounted at the extremity of the short sides of said T-shaped base and one leg being mounted at the extremity of the long side of the T-shaped base, said L-shaped panel having a plurality of blind orifices along the edge located at a modular distance, said T-shaped base being provided with a plurality of orifices, and a plurality of pins for insertion into the blind orifices of said L-shaped panel for connection of at least two basic elements.

The connection between a plurality of basic elements is additionally achieved by means of rectangular boards having two orifices at the extremities and two smaller orifices in the center of the edge of the longer sides of said rectangular boards or rectangular boards having a plurality of orifices at modular distance.

11 Claims, 21 Drawing Figures

STRUCTURE MADE UP OF SEVERAL COMPONENTS PARTICULARLY FOR USE IN CLASSROOMS

The present invention relates to tables made up of different components and relates particularly to tables for educational use, that is tables intended to constitute the entire furniture for classrooms and particularly for nursery schools, or the lower grade of elementary schools.

It is well-known that one of the fundamental requirements of a modern school for young children is to eliminate the rigid structures of the furniture, traditionally consisting of benches which may provide one or more seats and which usually are anchored or intended to be fixed and which are arranged in rigidly predetermined locations, that is in parallel rows, dominated by the teacher's desk which is frequently on a platform.

The traditionally rigid structures which constitute the conventional furniture of a schoolroom, unavoidably influence the feelings of a child who is subjected to the hierarchy of the teacher also in formal matters as a coactive imposition, the child thus being in a state of mind which leads to either a lack of discipline as a necessity on the part of the child to free himself from the domination of the teacher or to inactivity as a form of protest against the fixed location in the traditional classroom.

The object of the present invention is to provide a table made up of several components and to create furniture which may be easily transformed even in the short period of one classroom day according to the different requirements of an active classroom so that the child becomes protagonist of his daily activities while the teacher lives with the children and does not dominate the children from the height of the teacher's desk but the teacher is close to the children during the same activities.

The component elements of the assembly in accordance with the present invention permit to achieve innumerable combinations depending whether one wants to form a square table or a table in the shape of a horseshoe or a ring or a double-T with intermediate passages or a broken polygonal shape. Further, the component elements according to the present invention permit to arrange the table in a shape resembling a small theater or a board for scenic views or a small enclosure for toys. The component elements according to the present invention may also permit to achieve structures for gymnastic exercises of different types. All these changes may be achieved by means of extremely simple transformations which may be carried out by the children themselves under the supervision of the teacher with no danger and without any physical effort superior to the physical strength of the children.

The basic element which characterizes the table according to the present invention consists of a board in the shape of an "L", preferably made of compressed wood, with a support comprising three legs connected by a frame in the shape of a "T". The basic element is realized in two forms, that is respectively the right and the left element, which are symmetrical with respect to each other. Both the edges which define the basic panel as well as the frame of the support base are provided with orifices which permit the insertion of connecting elements, the connecting element consisting of pins and wooden bars of different lengths as well as simple rectangular boards provided with orifices, which permit the assembly of several basic elements which may be identical or symmetrical, for the purpose of achieving a variety of possible combinations and which ensure the stability of the assembly.

The drawings illustrate the basic element with the accompanying structures used for the connection and the completion of the assembly. The drawings also illustrate several possible combinations of this basic element which are shown by way of illustration and which are not intended to limit the present invention, it being obvious that several other possible combinations may be realized by varying the number and the arrangement of the basic elements of the invention.

Figure 9:
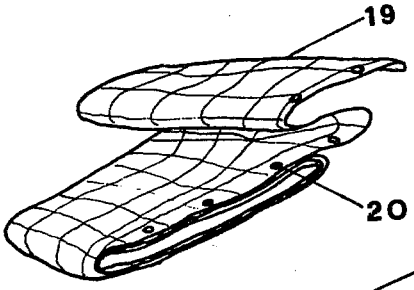
FIG. 9 is a piece of material provided with orifices used for covering the structure.

The basic element of the table comprises an upper planar board 1 in the shape of an "L", preferably made of compressed wood provided with several blind orifices 2, which are located along the edge at a constant modular distance, and a supporting frame 3, in the shape of a "T" which lies on a plane parallel to the upper board 1 and which is connected to the upper board 1 by means of three legs, 4, 5 and 6 respectively, of which 4 and 5 are located at the extremity of the short sections of the "T" and 6 which is located at the opposite extremity of the long section of the "T".

A small brace 7 also in the shape of a "T" is placed parallel to the frame 3 and adheres to the lower face of the board 1 so as to reinforce the structure.

Figure 2:
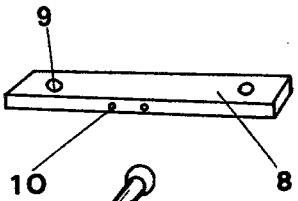
FIG. 2 represents a small board used for connection, provided with two large orifices and two small orifices.

FIG. 2 illustrates the small board 8 which has a rectangular shape and which is provided with orifices 9 of greater diameter at the extremities and with blind orifices 10 of smaller diameter along the edge in the center of the longer sides of the rectangle.

Figure 3:
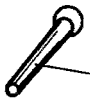
FIG. 3 represents a pin made of wood provided with a head.
Figure 4:
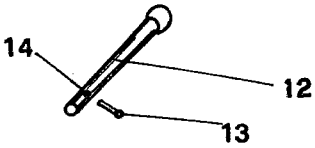
FIG. 4 is a pin provided with a head and also a small pin going through transversally.
Figure 5:
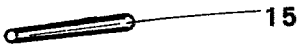
FIG. 5 represents a pin used for connection of other elements.
Figure 6:
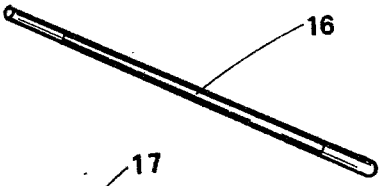
FIG. 6 is a bar used for connection of other elements.
Figure 7:
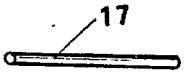
FIG. 7 is a small bar of cylindrical shape which at the end has a square cross section.

FIG. 3 illustrates pins 11 which are provided with a head; FIG. 4 illustrates pins 12 which are also provided with a head and the small wooden pin 13 which goes through the orifice 14, the orifice 14 being located at the end of the pin opposite the head. FIG. 5 illustrates cylindrical pins 15. FIG. 6 illustrates the bars 16 and FIG. 7 illustrates pins 17 of smaller diameter corresponding to the diameter of orifices 10 shown in FIG. 2, for the reciprocal connection of the basic elements.

Figure 8:
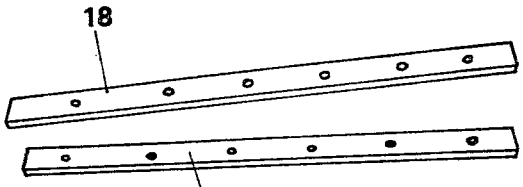
FIG. 8 represents a pair of flat bars used for connection, provided with orifices.

The assembly is completed by means of bars 18 shown in FIG. 8 which are provided with an orifice at a constant distance and which may have different lengths. FIG. 9 illustrates a strip of material 19 which may preferably be in lively colors and/or may be provided with printed designs and which is also provided with rings 20 along one of the longer sides, located at a modular distance.

Figure 1:
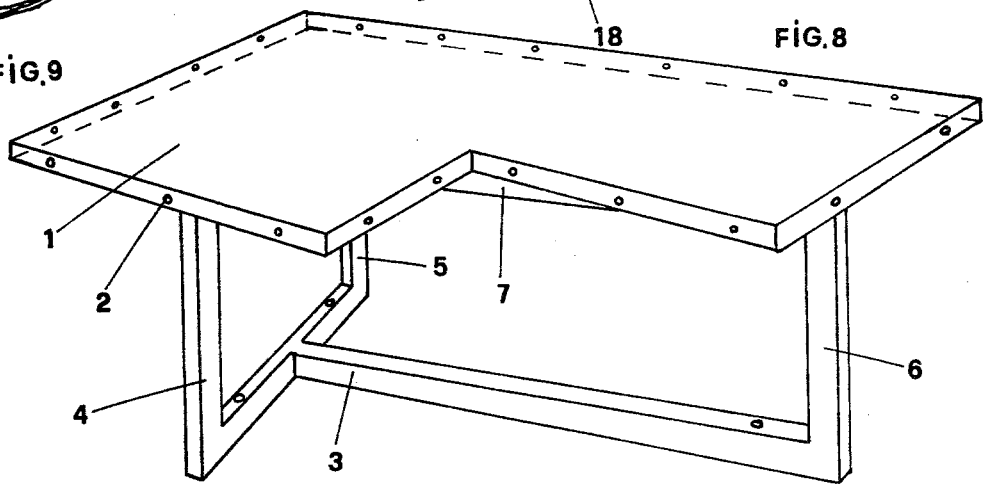
FIG. 1 represents the basic element of the table in perspective.

By means of two, four, six or even eight basic elements of the type shown in FIG. 1 and by means of appropriate number of the accessories illustrated in FIGS. 2–9 it is possible to achieve a great number of possible combinations for the furniture of a classroom, the combinations being illustrated by way of examples in FIGS. 10–21.

Figure 10:
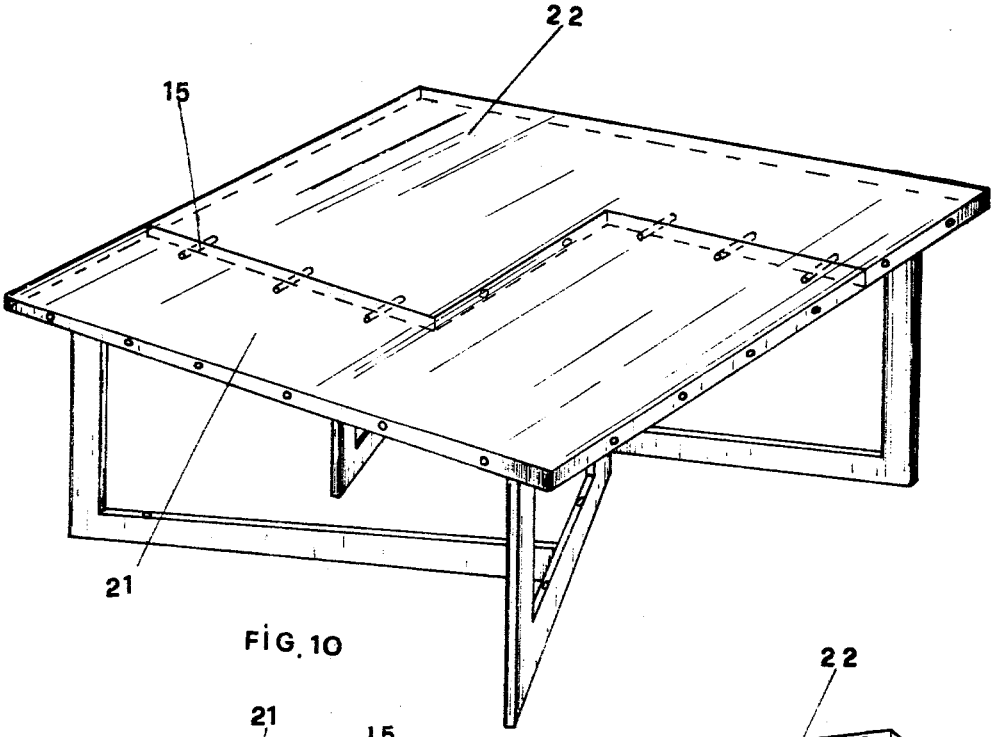
FIG. 10 illustrates a first possible combination consisting of two basic elements, forming a square table.
Figure 11:
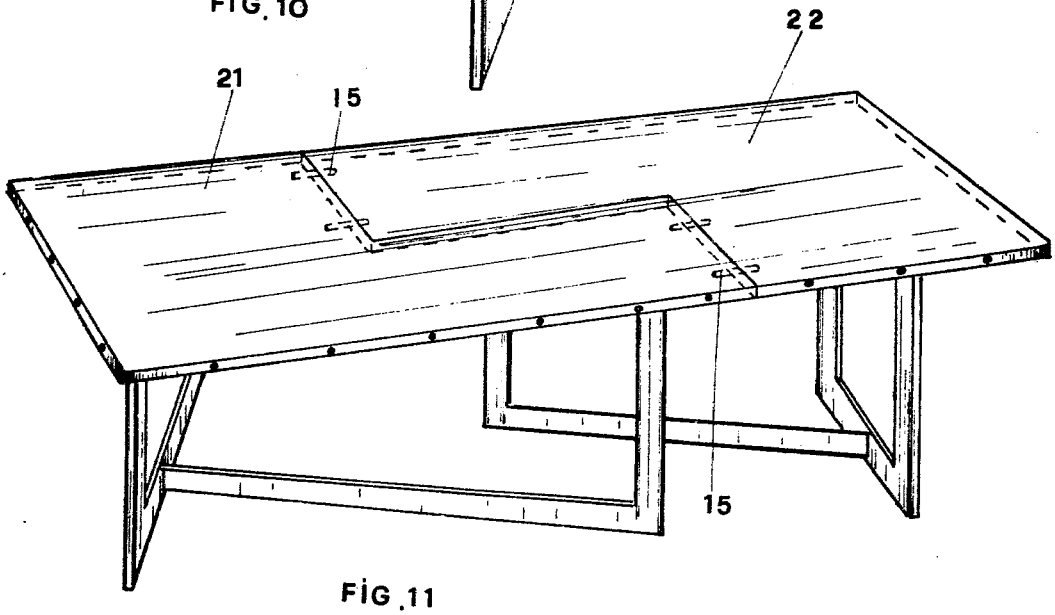
FIG. 11 represents a second possible combination of two basic elements forming a rectangular elongated table.
Figure 12:
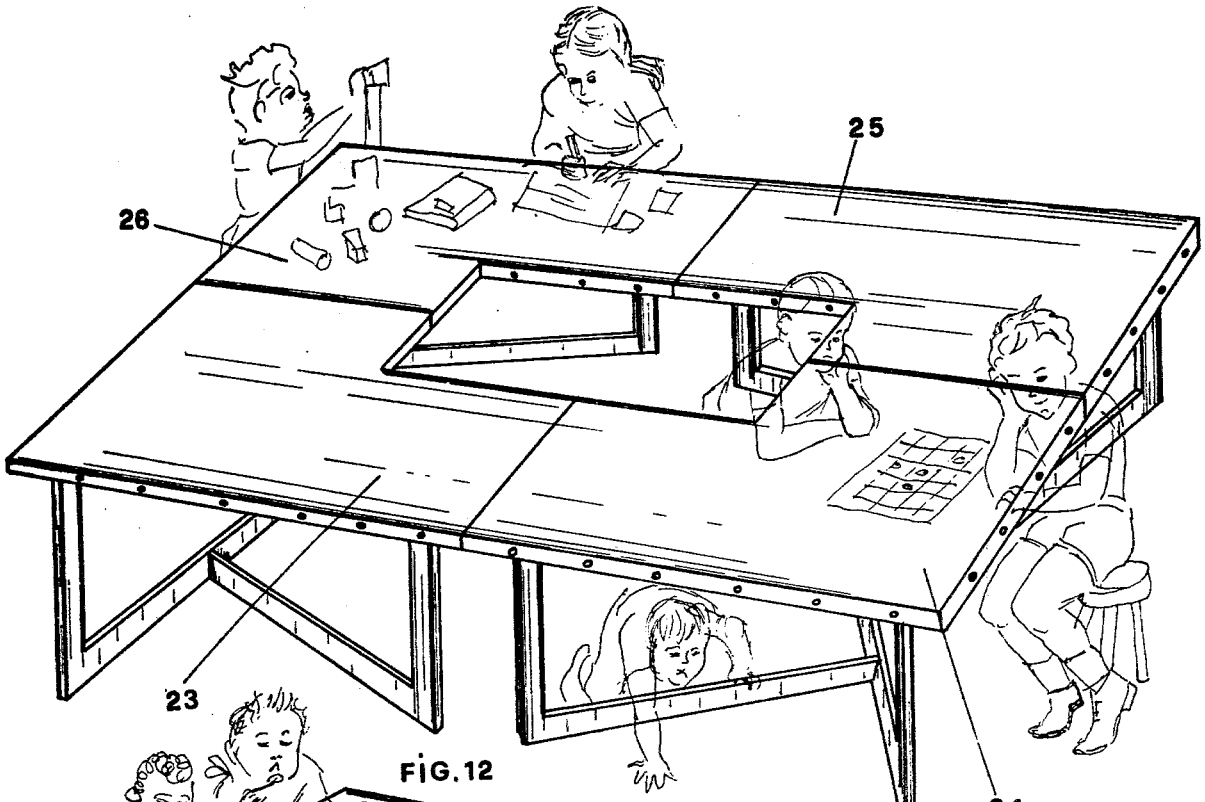
FIG. 12 represents a possible combination with four tables forming a unique rectangular assembly provided with an empty space in the middle.

For instance in FIGS. 10 and 11 it is possible to see two very simple combinations which comprise two basic elements respectively 21 and 22 which are mounted as shown in FIG. 10 with six pins 15. In view of the fact that the longer sides are in position opposite to each other, the combination gives a table of square shape. In FIG. 11 one sees four pins 15 which are used to connect two basic elements while leaving the external shorter sides of each basic element in position opposite to each other so that the assembly gives a table of elongated rectangular shape. FIG. 12 illustrates an assembly of four basic elements 23, 24, 25 and 26 connected by means of ten short pins so that the assembly forms a rectangular table with an opening in the middle, the opening also being of rectangular shape. With this arrangement children may be either on the external sides or in the middle of the table going through the center opening and may sit on light stools which are easily movable or on conventional chairs.

Figure 13:
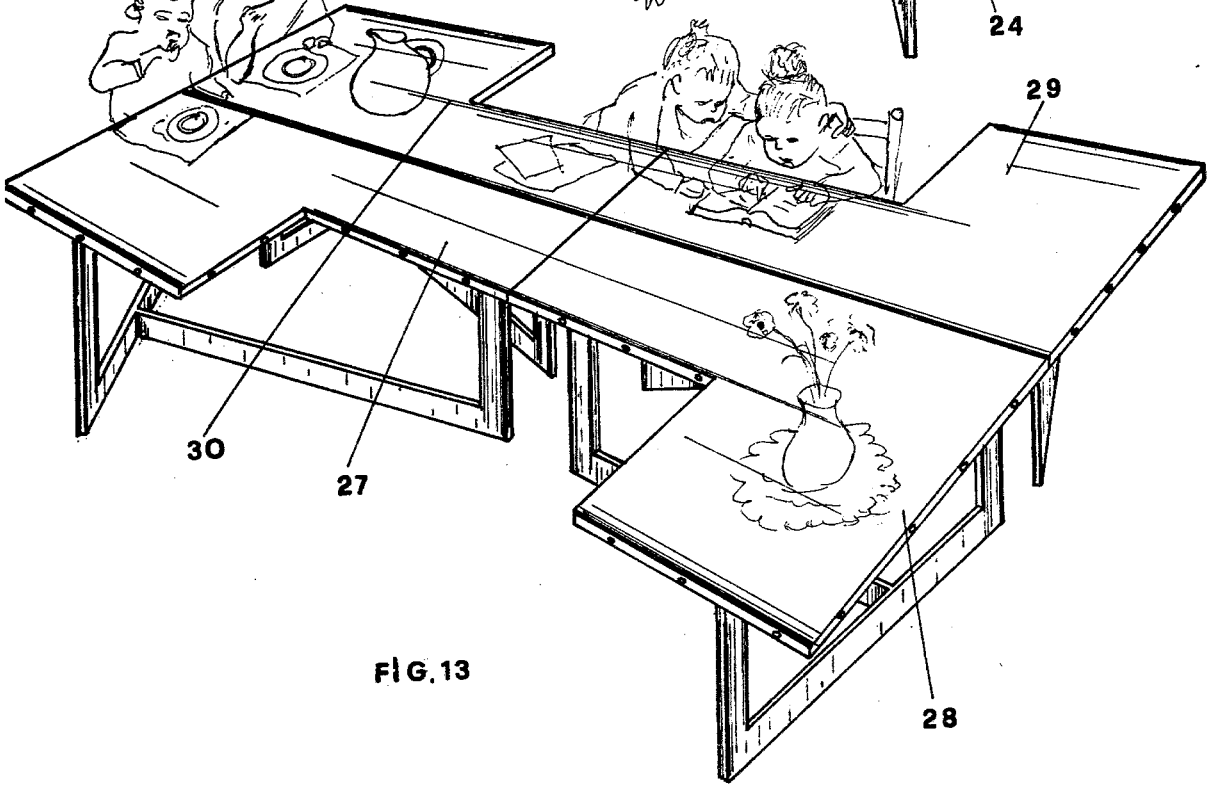
FIG. 13 represents still another combination of four basic elements forming a table having the shape essentially of a double T.

FIG. 13 illustrates four basic elements 27, 28, 29 and 30 which are arranged in the shape of a double T, in such a manner that each long side is interrupted by a recess and children may sit in the area corresponding to the recesses.

Figure 14:
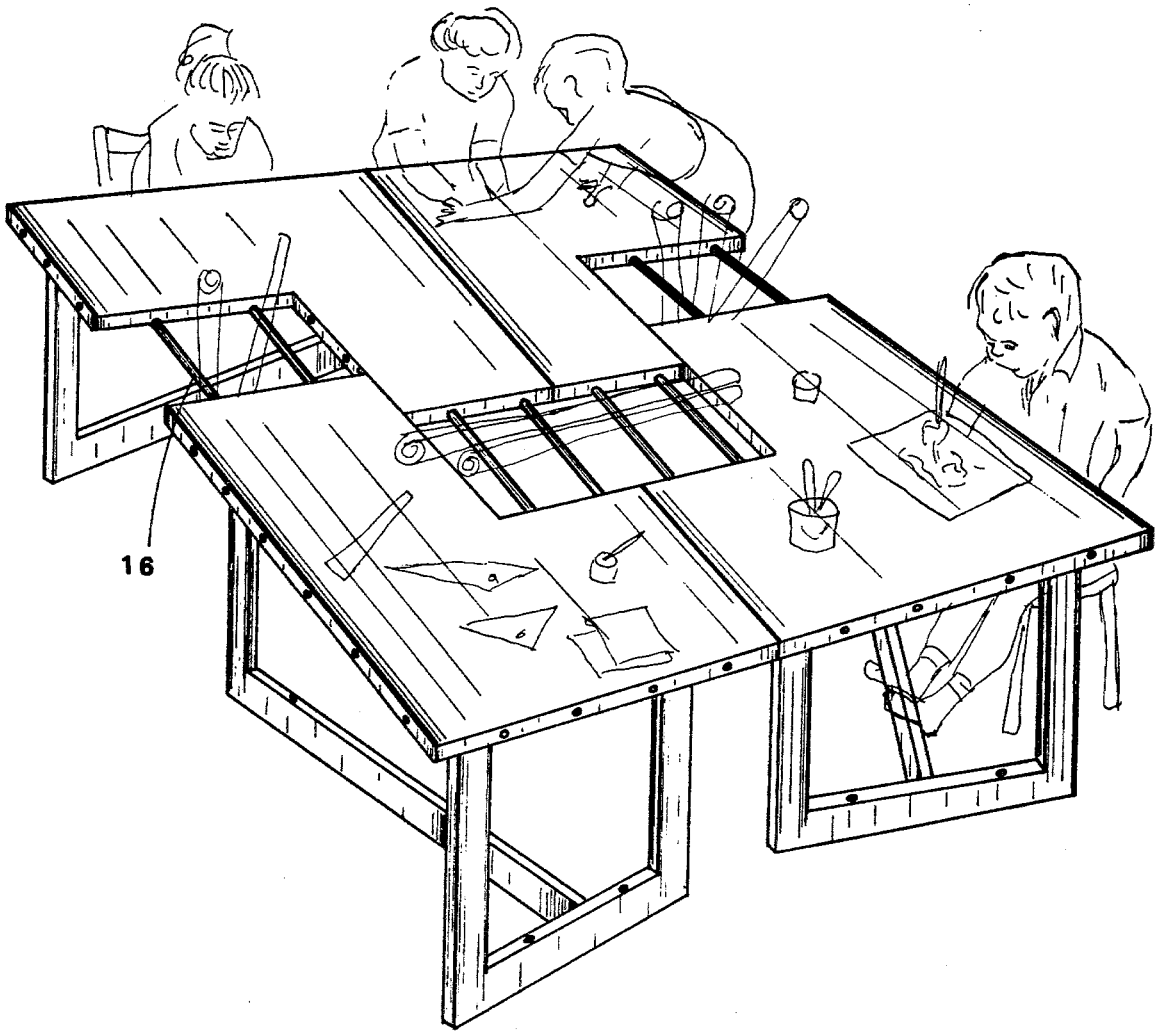
FIG. 14 represents a composite structure having four basic elements with intermediate spacer elements.

In the example illustrated in FIG. 14, four basic elements are combined, with two pairs of basic elements placed next to one another and with bars 16 which are placed in the three rectangular openings, two openings respectively being located in the longer sides and one central opening. In this manner there is obtained a table of greater size which permits to arrange the seating places at a greater distance one from the other.

Figure 15:
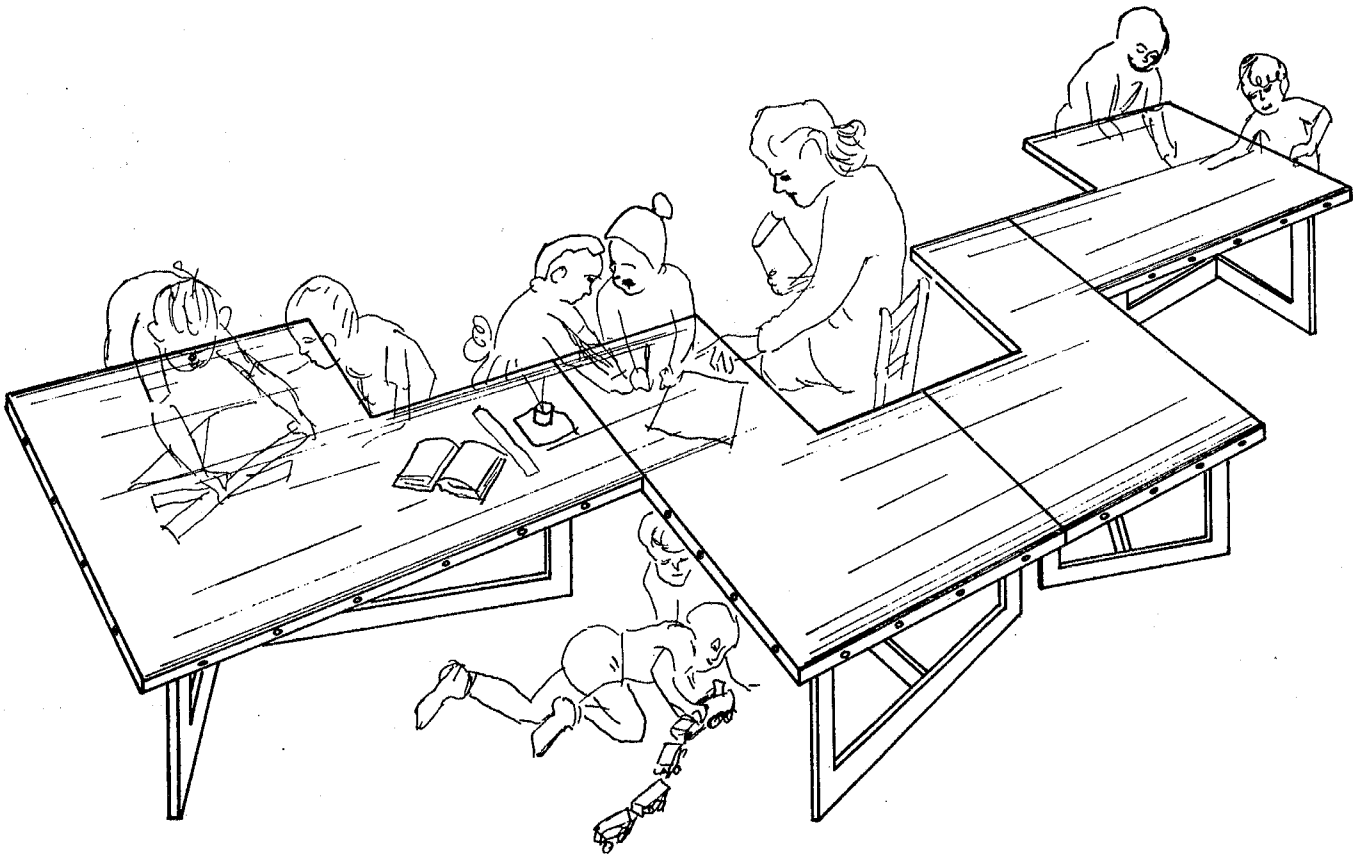
FIG. 15 represents an assembly of four basic elements which form a table having a discontinuous shape.

In the assembly shown in FIG. 15, the basic elements are connected among themselves along a line corresponding to the short side so that the assembly has an open polygonal arrangement, which comprises several internal corners, an arrangement which is attractive particularly to children.

Figure 16:
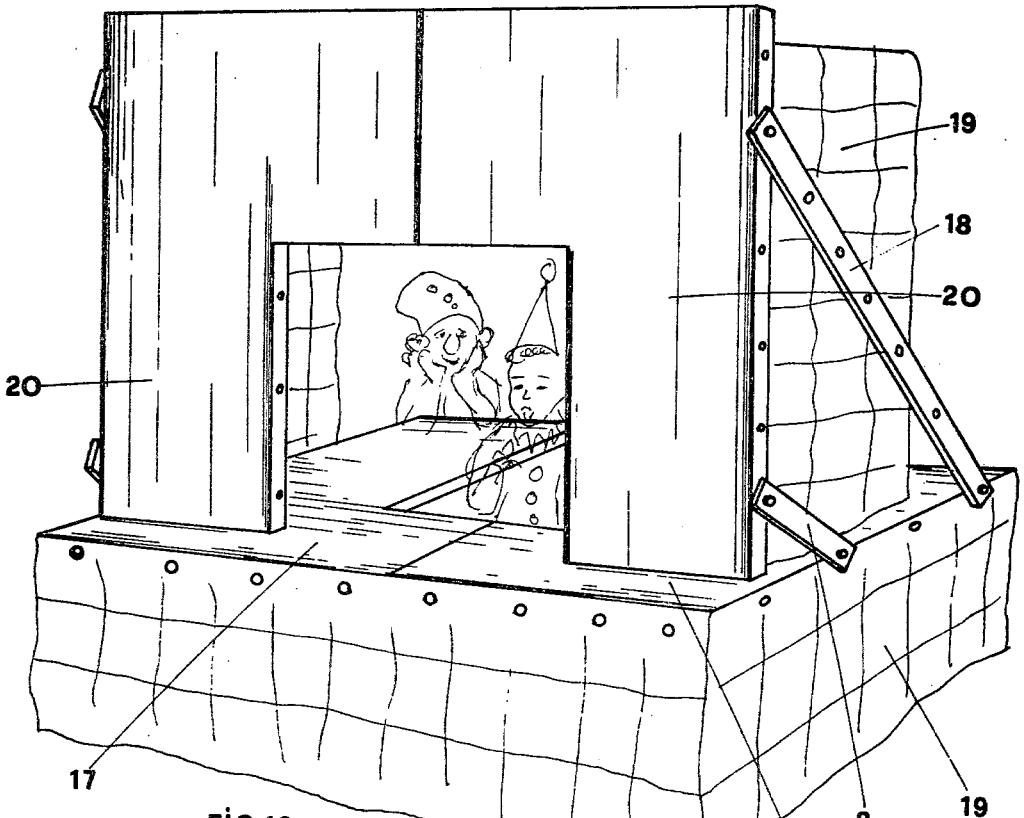
FIG. 16 represents an assembly of four basic elements forming a small theater.

FIG. 16 illustrates a small theater comprising four basic elements, and in more detail, the basic elements designated by numerals 17 and $17^1$ are connected to form a horseshoe which constitutes the base of the arena and the other two elements, in more detail 20 and $20^1$, are also connected in a manner to form a horseshoe but in a vertical arrangement, so as to form the opening of the arena. In this manner the children who play behind the pair of the basic elements may be seen by the public. In this assembly the short boards 8 and the long bars 18 are used diagonally to connect the vertical panels with the horizontal panels and they are placed along the edges of the longer sides.

The strips of material 19 are used to cover the sides of the basic elements so that the support elements are not visible and so as to complete the theater.

Figure 17:
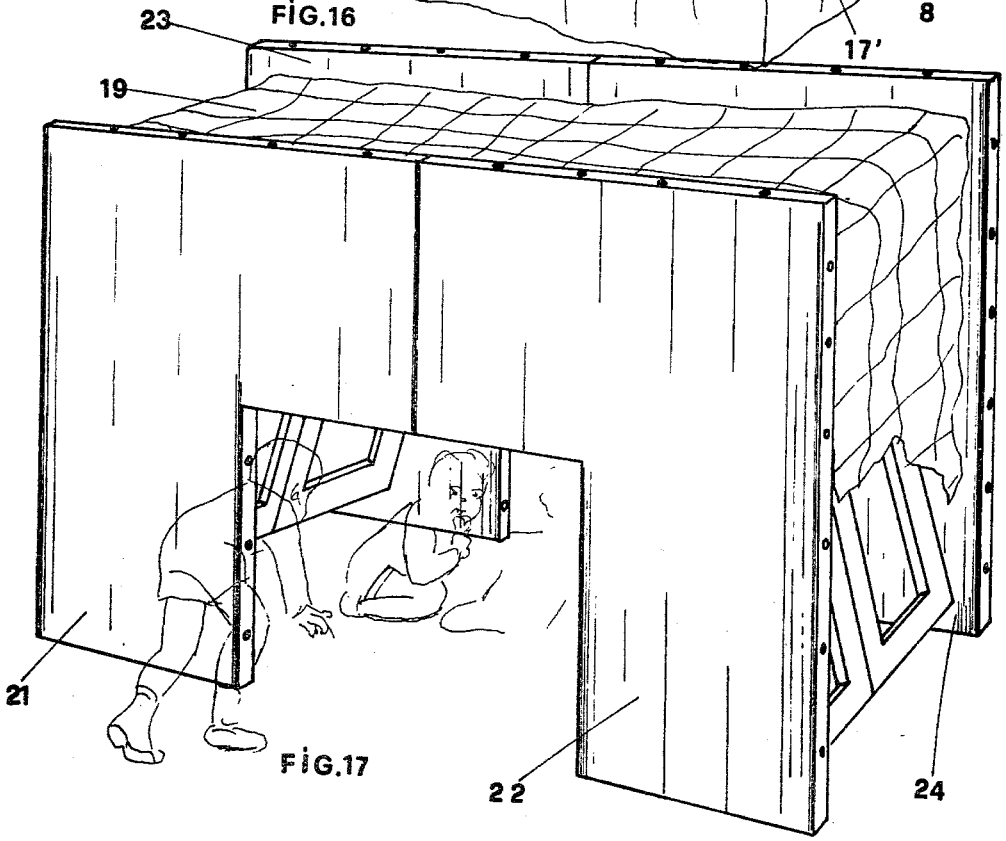
FIG. 17 represents an assembly of four basic elements having the shape of a small house.

In the arrangement illustrated in FIG. 17 four basic elements, respectively 21, 22, 23 and 24 are connected essentially in pairs with the boards arranged in the shape of a horse shoe and with the support elements reciprocally connected in opposite positions, so as to form a small house covered with the strip of material 19, under which the children can play.

Figure 18:
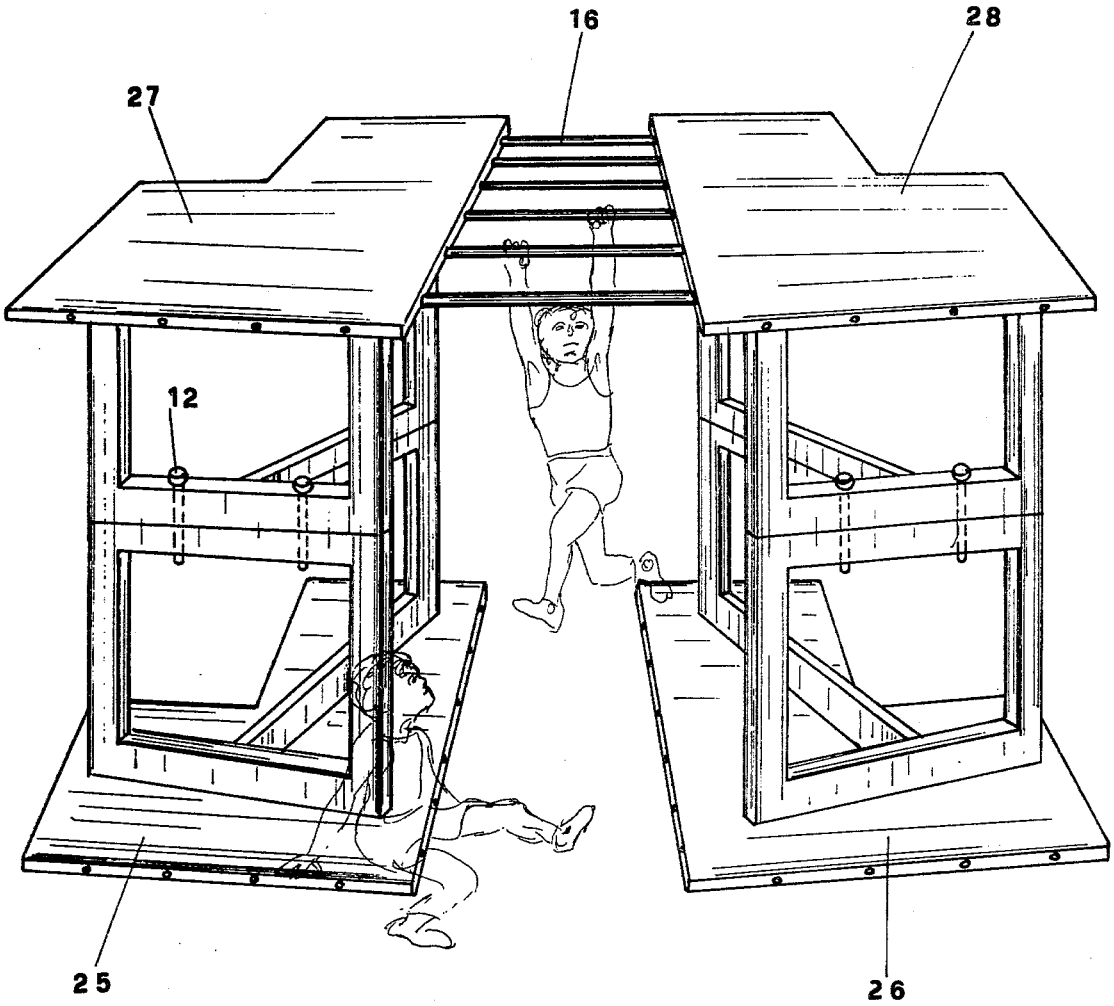
FIG. 18 represents an assembly of four basic elements useful for physical exercises.

In the assembly illustrated in FIG. 18, two basic elements 25 and 26 are arranged in inverted position, that is with the horizontal board at the bottom and with the support elements arranged upwardly. The two elements 25 and 26 are connected to two other basic elements, respectively 27 and 28 in such a manner that the short sides of the support elements in the shape of a "T" are reciprocally connected by means of pins with heads 12, the pins going through orifices located along the short sides of the "T" shaped support elements.

Bars 16 connect the upper boards of elements 27 and 28, thus forming spaces elements along which children may climb, thus doing gymnastic exercises.

Figures 19, 20:
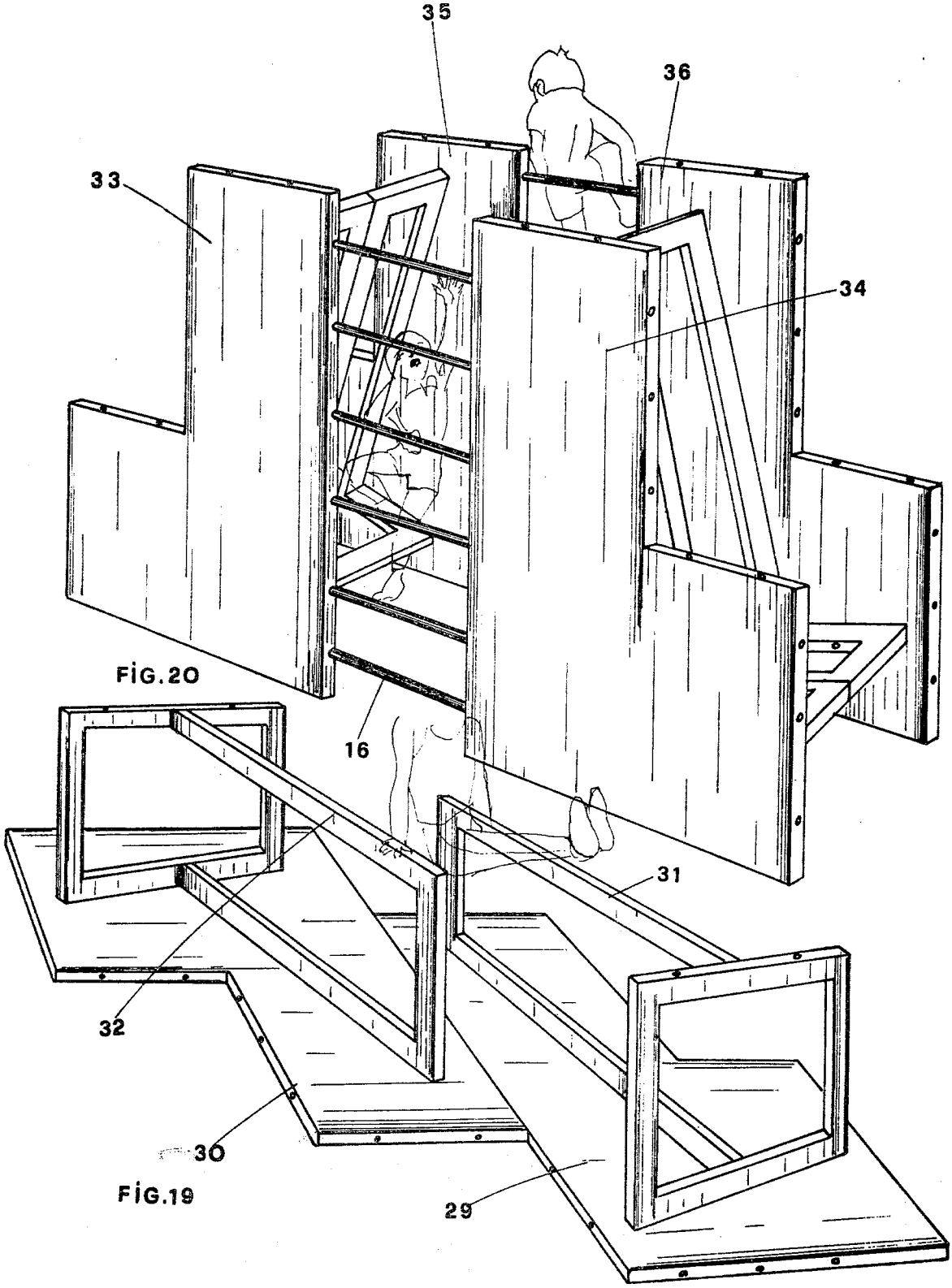
FIG. 19 represents an assembly of two basic elements in inverted position for physical exercises between the parallel elements.
FIG. 20 is an assembly of four basic elements useful for physical exercises.

In the assembly shown in FIG. 19 two basic elements 29 and 30 are arranged in inverted position, that is with the "L" shaped board at the bottom. They are connected in such a manner that the elements 31 and 32 which are part of the support element of "T" shape are arranged parallel one to the other, thus giving an assembly particularly useful for gymnastic exercises along parallel structures.

FIG. 20 shows four basic elements 33, 34, 35 and 36 which are arranged in pairs corresponding to the support members with the vertical boards opposite one to the other. The vertical boards of one pair are connected to the vertical boards of the other pair by means of bars 16. This arrangement forms a double ladder suitable for the exercises called Swedish gymnastics.

Figure 21:
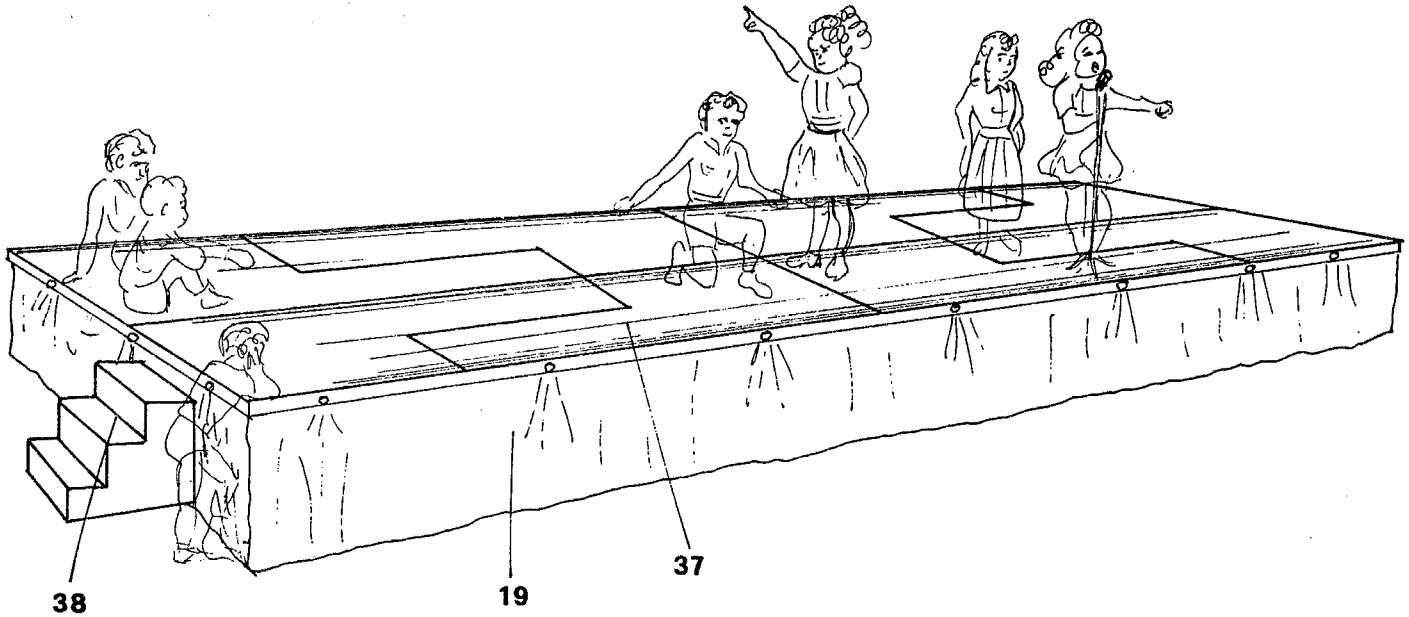
FIG. 21 is an assembly of eight basic elements in the shape of a board useful for scenic representations.

Finally by arranging eight basic elements and connecting the elements in pairs symmetrically, it is possible to form a raised platform 37 as shown in FIG. 21, which has a rectangular shape and which is covered on the two edges by means of the strip of material 19. A small ladder is provided, designated by numeral 38 at a location along the perimeter of the platform. This assembly permits to organize scenic representations which are capable of developing the imagination of children.

Some of the assemblies described herein and particularly the assemblies intended for gymnastic exercises may be reinforced by means of flat bars provided with orifices, which are fixed along the edges of the board of the basic element by means of the pins with heads 11, for the purpose of providing better safety for the children.

Obviously the possible combination which may be achieved according to the present invention by means of the basic element are not limited to the assemblies described hereinabove because these assemblies have only been described by way of example. It is also clear that the imagination of children, with the help and the supervision of the teacher, may give rise to a great number of other combinations, which may be achieved as the occasion arises according to the particular educational requirements. This great variety of combinations obviously makes the stay of children in the classroom more attractive and more lively.

Naturally the construction details of the tables made up of different components of the present invention may be varied without departing from the essential features of the present invention.

What is claimed is:

1. A structure made up of different components, particularly for use in classrooms, which comprises at least two basic elements, each of said basic elements comprising an L-shaped panel and a T-shaped base parallel to said L-shaped panel and three vertical legs connecting said L-shaped panel to said T-shaped base, two of said legs being mounted at the extremity of the short sides of said T-shaped base and one leg being mounted at the extremity of the long side of the T-shaped base, the long side of said T-shaped base being arranged at an angle with respect to the long side of the L-shaped panel and being totally overlaid by said L-shaped panel, said L-shaped panel having a plurality of blind orifices along the edge located at a modular distance, said T-shaped base being provided with a plurality of orifices, and a plurality of pins for insertion into the blind orifices of said L-shaped panel for connection of at least two basic elements, the three legs and the T-shaped base being the sole support for the L-shaped panel, additionally comprising a T-shaped brace means interconnecting the legs and parallel to the long side of the T-shaped base attached to the lower face of the L-shaped panel.

2. The structure according to claim 1 wherein the connection between a plurality of basic elements is additionally achieved by means of rectangular boards having two orifices at the extremities and two smaller orifices in the center of the edge of the longer sides of said rectangular boards.

3. The structure according to claim 1 wherein the connection between a plurality of basic elements is additionally achieved by means of rectangular boards having a plurality of orifices at modular distance.

4. The structure according to claim 1 which is a table which comprises two basic elements, wherein the longer sides of said L-shaped panels are arranged one opposite to the other and the table has a square shape.

5. The structure according to claim 1 which is a table which comprises two basic elements, the short sides of said L-shaped panels are opposite one to the other and the table has a rectangular shape.

6. The structure according to claim 1 which is a table which comprises two pairs of basic elements, the long side of each L-shaped panel of each pair being coaligned with the long side of one of the L-shaped panels of the other pair.

7. The structure according to claim 1 which is a table which comprises two pairs of basic elements, the long sides of each pair of the L-shaped elements being in contact with the long sides of the other pair.

8. The structure according to claim 1 which is a table which comprises four basic elements, one pair of basic elements being arranged with the long sides of the L-shaped panels in contact one with the other and the other pair having the short sides in contact one with the other and a plurality of bars in the empty spaces between said L-shaped panels.

9. The structure according to claim 2 which simulates a theater which comprises two pairs of basic elements, each arranged in horseshoe shape, one pair being horizontally arranged and the other pair being vertically arranged, said rectangular boards connecting the long sides of the two pairs of said L-shaped panels.

10. The structure according to claim 1 which simulates a house which comprises two pairs of basic elements in the shape of a horseshoe, both pairs being vertically arranged and the L-shaped panels being in the exterior.

11. The structure according to claim 1 which comprises two pairs of basic elements, one pair being the upper pair and the other pair being the lower pair, the lower pair being in inverted position, the long sides of the L-shaped panels of one pair facing the long sides of the L-shaped panels of the other pair, and a plurality of horizontal bars connecting said long sides of the L-shaped panels of the upper pair.

* * * * *